US008046933B2

(12) United States Patent
Yoo et al.

(10) Patent No.: US 8,046,933 B2
(45) Date of Patent: Nov. 1, 2011

(54) APPARATUS FOR DETECTING A BELT-CUTOFF OF DRYER AND METHOD FOR DETECTING THE SAME

(75) Inventors: Hea Kyung Yoo, Seoul (KR); Jun Seok Lee, Daegu (KR); Seog Ho Go, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 975 days.

(21) Appl. No.: 11/865,529

(22) Filed: Oct. 1, 2007

(65) Prior Publication Data

US 2008/0184585 A1 Aug. 7, 2008

(30) Foreign Application Priority Data

Oct. 2, 2006 (KR) ..... 10-2006-0096895
Oct. 2, 2006 (KR) ..... 10-2006-0096899

(51) Int. Cl.
*F26B 11/00* (2006.01)

(52) U.S. Cl. ..... 34/599; 34/604; 34/610; 68/16; 68/19

(58) Field of Classification Search ..... 34/595, 34/599, 600, 601, 604, 610, 210, 87; 68/19, 68/16
See application file for complete search history.

(56) References Cited

U.S. PATENT DOCUMENTS 2,315,354 A * 3/1943 Shanman ..... 34/82
2,385,223 A * 9/1945 Moore ..... 34/599
2,389,433 A * 11/1945 Hough ..... 34/87
2,486,058 A * 10/1949 Patterson et al. ..... 34/82
2,503,329 A * 4/1950 Geldhof et al. ..... 34/604
2,517,421 A * 8/1950 Geldhof ..... 432/117
2,521,712 A * 9/1950 Geldhof ..... 34/82
2,553,581 A * 5/1951 Hatfield ..... 68/12.14
2,577,104 A * 12/1951 Butler ..... 34/572
2,589,284 A * 3/1952 O'Neil ..... 34/77
2,641,062 A * 6/1953 Wentz ..... 34/546
2,688,471 A * 9/1954 Robinson et al. ..... 366/232
2,707,837 A * 5/1955 Paulsen et al. ..... 34/607
2,737,729 A * 3/1956 Engel ..... 34/602
2,750,782 A * 6/1956 Hamell, Jr. ..... 68/140
2,792,640 A * 5/1957 Patterson ..... 34/75
2,795,055 A * 6/1957 Huebsch ..... 34/82
2,802,283 A * 8/1957 Strike ..... 34/87
2,803,454 A * 8/1957 Tatro ..... 74/89.22
2,809,442 A * 10/1957 Glasby, Jr. ..... 34/82
2,814,130 A * 11/1957 Cayot ..... 34/82
2,817,157 A * 12/1957 McCormick ..... 34/82
2,827,276 A * 3/1958 Racheter ..... 432/62

(Continued)

FOREIGN PATENT DOCUMENTS

DE 3933949 A1 * 4/1991

(Continued)

*Primary Examiner* — Stephen M. Gravini
(74) *Attorney, Agent, or Firm* — Birch, Stewart, Kolasch & Birch, LLP

(57) ABSTRACT

Disclosed is an apparatus for detecting a belt-cutoff of a dryer. The apparatus comprises a drying drum accommodating a laundry therein; a motor applying a rotational force to the dry drum; a belt wound around the drying drum and a rotating shaft of the motor; and a belt cut detecting unit provided adjacent to the motor in order to sense the belt-cutoff, wherein the belt cut detecting unit is pressed as the motor is rotated by a turning moment when the belt is cut off.

6 Claims, 10 Drawing Sheets

U.S. PATENT DOCUMENTS 2,843,945 A * 7/1958 Whyte ..... 34/82
2,851,791 A * 9/1958 Olthuis ..... 34/90
2,851,793 A * 9/1958 Thompson ..... 34/601
2,853,798 A * 9/1958 Morrison ..... 34/75
2,856,699 A * 10/1958 Frey ..... 34/75
2,861,355 A * 11/1958 Douglas ..... 34/82
2,864,249 A * 12/1958 Nichols ..... 68/19
2,864,250 A * 12/1958 Nichols ..... 68/19.1
2,865,111 A * 12/1958 Geldhof ..... 34/95
2,878,662 A * 3/1959 Brucken ..... 68/19.2
2,892,335 A * 6/1959 Gray, Jr. ..... 68/16
2,949,679 A * 8/1960 MacCracken et al. ..... 34/598
2,959,044 A * 11/1960 Stone ..... 68/12.15
2,961,863 A * 11/1960 Sulcek ..... 68/20
2,975,623 A * 3/1961 Eichhorn et al. ..... 68/12.15
2,983,050 A * 5/1961 Alaback ..... 34/90
2,985,966 A * 5/1961 Martin ..... 34/75
3,050,974 A * 8/1962 Smith ..... 68/20
3,061,942 A * 11/1962 Scofield ..... 34/82
3,087,351 A * 4/1963 Ross ..... 74/368
3,102,008 A * 8/1963 Pansing et al. ..... 34/79
3,121,000 A * 2/1964 Hubbard ..... 34/75
3,155,462 A * 11/1964 Erickson et al. ..... 34/82
3,220,120 A * 11/1965 Ross ..... 34/601
3,316,659 A * 5/1967 Lauck ..... 34/600
3,328,897 A * 7/1967 Purkett ..... 34/599
3,387,385 A * 6/1968 Mandarino, Jr. et al. ..... 34/596
3,457,656 A * 7/1969 Fox ..... 34/601
3,509,640 A * 5/1970 Davis et al. ..... 34/601
3,555,701 A * 1/1971 Hubbard ..... 34/602
3,696,521 A * 10/1972 Hubbard ..... 34/128
3,729,834 A * 5/1973 Fox ..... 34/139
3,805,404 A * 4/1974 Gould ..... 34/75
3,859,004 A * 1/1975 Condit ..... 34/75
3,890,719 A * 6/1975 Braga et al. ..... 34/572
4,015,930 A * 4/1977 Grantham ..... 432/105
4,159,632 A * 7/1979 Grantham ..... 68/9
4,300,293 A * 11/1981 Gladysz ..... 34/108
4,369,479 A * 1/1983 Rickard ..... 361/1
4,430,809 A * 2/1984 Jackson et al. ..... 34/601
4,488,363 A * 12/1984 Jackson et al. ..... 34/572
4,669,199 A * 6/1987 Clawson et al. ..... 34/82
4,702,018 A * 10/1987 Hastings ..... 34/130
4,726,125 A * 2/1988 Pellerin ..... 34/82
4,753,018 A * 6/1988 Golichowski ..... 34/603
4,754,556 A * 7/1988 Carr ..... 34/601
4,765,092 A * 8/1988 Cline ..... 47/61
5,771,604 A * 6/1998 Wunderlich et al. ..... 34/603
5,887,456 A * 3/1999 Tanigawa et al. ..... 68/20
6,062,049 A * 5/2000 Martinsson ..... 68/140
6,434,857 B1 * 8/2002 Anderson et al. ..... 34/595
6,671,978 B1 * 1/2004 McGowan et al. ..... 34/596
6,745,495 B1 * 6/2004 Riddle et al. ..... 34/497
6,751,888 B2 * 6/2004 Lueckenbach ..... 34/595
6,829,845 B2 * 12/2004 Han et al. ..... 34/603
6,874,248 B2 * 4/2005 Hong et al. ..... 34/239
6,941,678 B2 * 9/2005 Park ..... 34/528
6,941,679 B1 * 9/2005 Harris et al. ..... 34/596
6,967,297 B2 * 11/2005 Muller et al. ..... 200/61.58 B
6,968,632 B2 * 11/2005 Guinibert et al. ..... 34/602
6,995,965 B2 * 2/2006 Hameed et al. ..... 361/91.1
6,996,920 B2 * 2/2006 Bang et al. ..... 34/494
7,055,262 B2 * 6/2006 Goldberg et al. ..... 34/86
7,065,904 B2 * 6/2006 Lee et al. ..... 34/601
7,065,905 B2 * 6/2006 Guinibert et al. ..... 34/603
7,178,265 B2 * 2/2007 Ford ..... 34/601
7,207,124 B2 * 4/2007 Kim ..... 34/601
7,225,562 B2 * 6/2007 Guinibert et al. ..... 34/601
7,257,905 B2 * 8/2007 Guinibert et al. ..... 34/82
7,263,787 B2 * 9/2007 Besaw ..... 34/62
7,325,330 B2 * 2/2008 Kim et al. ..... 34/407
7,340,848 B2 * 3/2008 Ford ..... 34/601
7,467,483 B2 * 12/2008 Guinibert et al. ..... 34/601
7,523,564 B2 * 4/2009 Doh ..... 34/601
7,536,807 B2 * 5/2009 Baier ..... 34/601
7,562,467 B2 * 7/2009 Doh ..... 34/601
7,609,491 B2 * 10/2009 Johnson et al. ..... 361/23
7,614,162 B2 * 11/2009 Renzo ..... 34/603
7,627,960 B2 * 12/2009 Beyerle et al. ..... 34/602
7,644,515 B2 * 1/2010 Doh ..... 34/603
7,661,202 B2 * 2/2010 Han et al. ..... 34/595
7,748,139 B2 * 7/2010 Hong et al. ..... 34/601
7,762,007 B2 * 7/2010 Guinibert et al. ..... 34/601
7,765,716 B2 * 8/2010 Kim ..... 34/602
7,836,607 B2 * 11/2010 Kim ..... 34/595
2003/0000106 A1 * 1/2003 Anderson et al. ..... 34/598
2004/0060196 A1 * 4/2004 Lueckenbach ..... 34/595
2004/0123486 A1 * 7/2004 Hameed et al. ..... 34/595
2004/0134092 A1 * 7/2004 Hong et al. ..... 34/595
2004/0134093 A1 * 7/2004 Han ..... 34/595
2004/0163276 A1 * 8/2004 Han et al. ..... 34/603
2005/0076535 A1 * 4/2005 Guinibert et al. ..... 34/601
2005/0102854 A1 * 5/2005 Lee et al. ..... 34/602
2005/0115104 A1 * 6/2005 Guinibert et al. ..... 34/601
2005/0120585 A1 * 6/2005 Lee et al. ..... 34/602
2005/0132601 A1 * 6/2005 Doh ..... 34/601
2005/0132604 A1 * 6/2005 Hong et al. ..... 34/603
2006/0107548 A1 * 5/2006 Ford ..... 34/601
2006/0117596 A1 * 6/2006 Kim et al. ..... 34/607
2006/0130358 A1 * 6/2006 Kim ..... 34/494
2006/0254083 A1 * 11/2006 Ford ..... 34/601
2006/0254084 A1 * 11/2006 Ford ..... 34/601
2006/0260150 A1 * 11/2006 Doh ..... 34/601
2007/0006477 A1 * 1/2007 Guinibert et al. ..... 34/85
2007/0017119 A1 * 1/2007 Besaw ..... 34/602
2007/0186440 A1 * 8/2007 Guinibert et al. ..... 34/603
2007/0220776 A1 * 9/2007 Guinibert et al. ..... 34/603
2007/0256322 A1 * 11/2007 Kim et al. ..... 34/603
2008/0022551 A1 * 1/2008 Banta et al. ..... 34/602
2008/0060218 A1 * 3/2008 Doh ..... 34/601
2009/0170048 A1 * 7/2009 Kim ..... 432/219
2009/0260246 A1 * 10/2009 Bae et al. ..... 34/60
2009/0272004 A1 * 11/2009 Chernetski et al. ..... 34/389
2009/0282694 A1 * 11/2009 Magennis et al. ..... 34/337
2009/0320321 A1 * 12/2009 Jergens et al. ..... 34/499

FOREIGN PATENT DOCUMENTS

DE 4225770 A1 * 2/1994
DE 19636705 A1 * 3/1998
DE 19728068 A1 * 1/1999
EP 26018 A1 * 4/1981
EP 110318 A1 * 6/1984
EP 285072 A2 * 10/1988
EP 312065 A1 * 4/1989
EP 384149 A1 * 8/1990
EP 709515 A1 * 5/1996
EP 1564324 A1 * 8/2005
FR 2705373 A1 * 11/1994
GB 2300686 A * 11/1996
JP 02195986 A * 8/1990
JP 10225591 A * 8/1998
WO WO 03/087459 A1 * 10/2003
WO WO 2005064065 A1 * 7/2005

* cited by examiner

APPARATUS FOR DETECTING A BELT-CUTOFF OF DRYER AND METHOD FOR DETECTING THE SAME

CROSS-REFERENCE TO RELATED APPLICATIONS

The present application claims priority under 35 U.S.C. 119 and 35 U.S.C. 365 to Korean Patent Application No. 10-2006-0751131 (filed on Oct. 2, 2006) and 10-2006-0096899 (filed on Oct. 2, 2006), which are hereby incorporated by reference in its entirety.

BACKGROUND

1. Field

This document relates to an apparatus for detecting a belt-cutoff of a dryer and a method for detecting the same.

2. Description of the Related Art

Generally, a drum-type dryer is designed to perform the drying operation while rotating laundry loaded in a dry drum. The laundry rotates and drops by the rotation of the dry drum. High-temperature dry air introduced into the drying drum is mixed with the laundry to vaporize the moisture soaked in the laundry. The dryer may be classified into a condenser-type dryer and an exhaust-type dryer. The former is designed such that the air in the drying drum is directed to a condenser and a heater and is then returned to the dry drum. That is, the air circulates in the dryer without being exhausted out of the dryer. The latter is designed such that the air in the drying drum is directed to the condenser so that the moisture contained in the air can be eliminated and is then exhausted out of the dryer.

Particularly, according to the condenser-type dryer, the air circulating in the dryer absorbs the moisture from the laundry loaded in the drum and passes through the condenser to be lowered in its temperature by a heat-exchange. As the temperature of the air is lowered, the moisture contained in the air is condensed. The condensed water is pumped out by a condensing pump and is then exhausted to outside.

On the other hand, according to the exhaust-type dryer, high-temperature high-moisture air absorbing moisture from the laundry in the drum is exhausted out of the dryer via a lint filter.

In both the exhaust-type and condenser type dryers, as the laundry lifts and drops by the rotation of the drum, heat-exchange between the high-temperature dry air and the laundry is briskly incurred.

Meanwhile, according to the conventional drum-type dryer, a drum belt is wound around an outer circumference of the drum, and also the drum belt is wound around a motor shaft, and therefore the drying drum is rotated by a rotational force of the motor.

SUMMARY

An object of the present invention is to provide an apparatus for detecting a belt-cutoff of a dryer and a method for detecting the same.

Particularly, an object of the present invention is to provide an apparatus for detecting a belt-cutoff of a dryer and a method for detecting the same, which prevent some of clothes loaded in the drum from being locally heated and fired by stopping the operation of the motor and heater when the drum belt is cut during the drying process.

In addition, another object of the present invention is to provide an apparatus for detecting a belt-cutoff of a dryer and a method for detecting the same, which reduce unnecessary power consumption by stopping the operation of the motor and heater simultaneously with the belt-cutoff.

To achieve these objects and other advantages and in accordance with the purpose of the invention, as embodied and broadly described herein, there is provided an apparatus for detecting a belt-cutoff of a dryer including: a drying drum in which a laundry is received; a motor applying a rotational force to the dry drum; a belt wound around the drying drum and a rotating shaft of the motor; and a belt cut detecting unit provided adjacent to the motor to sense the belt-cutoff, wherein the belt cut detecting unit is pressed as the motor is rotated by a turning moment when the belt is cut off.

In another aspect of the present invention, there is provided an apparatus for detecting a belt-cutoff of a dryer including: a dry drum; a motor rotating the drying drum and provided with a pressing element which is protruded from one side of an outer circumference; a spring supporting the motor; a belt wound around the drying drum and a rotating shaft of the motor; and a micro switch contacting with the pressing element when the belt is cut off.

In addition, to achieve these objects and other advantages, there is provided a method for detecting a belt-cutoff of a dryer including: rotating of a drying drum by an input of an operation command; turning on a belt cut detecting unit because a belt wound around a drying drum is cut; and stopping a heater and a motor when the belt cut detecting unit is turned on.

In another aspect of the present invention, there is provided a method for detecting a belt-cutoff of a dryer, wherein the cutoff of the belt which connects the drying drum with the motor is decided by the action of the motor pressing the belt cut detecting unit as the motor itself is rotated.

DETAILED DESCRIPTION OF THE PREFERRED EMBODIMENTS

Hereinafter, the present invention will be explained in detail with reference to accompanying drawings. However, the present invention is not limited to the following examples, but various variations and modifications may be made without departing from the scope of the present invention by adding, alternating and deleting further another constituents.

Figure 1:
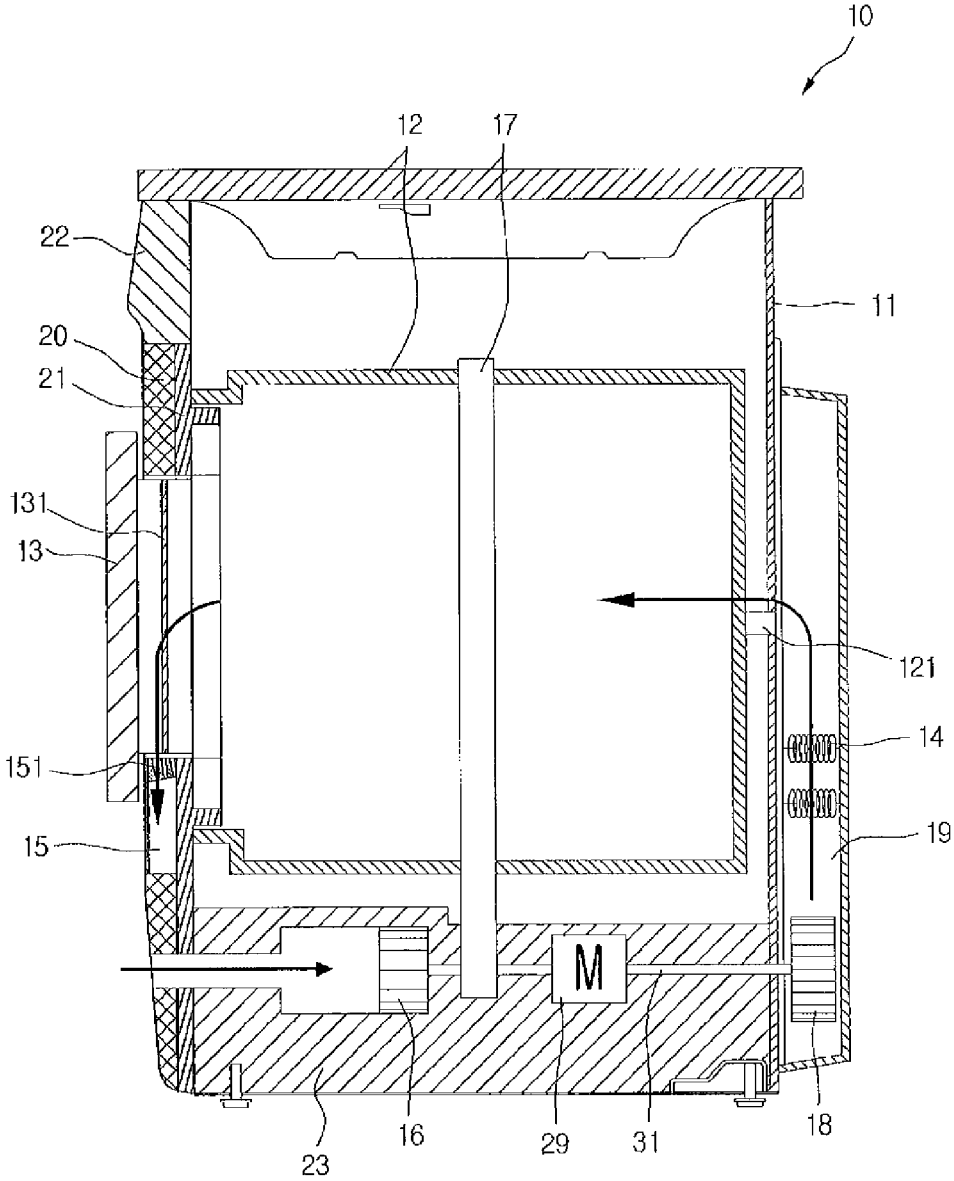
FIG. 1 is a cross-sectional view of a dryer having an apparatus for detecting a belt-cutoff according to a preferred embodiment of the present invention.
Figure 2:
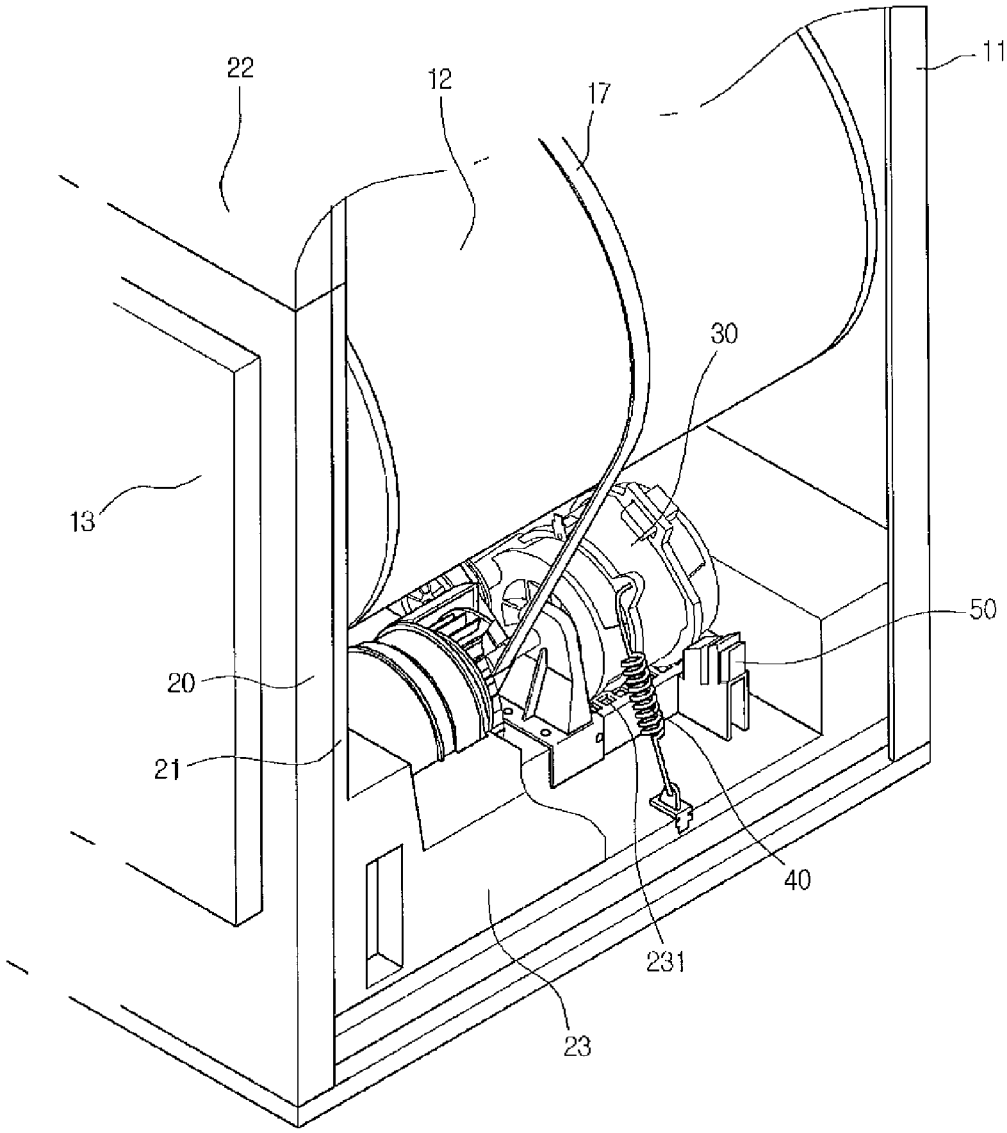
FIG. 2 is a perspective view showing an inner structure of the dryer.

FIG. 1 shows a cross-sectional view of a dryer having an apparatus for detecting a belt-cutoff according to a preferred embodiment of the present invention, and FIG. 2 shows a perspective view of an inner structure in the dryer.

Referring to FIGS. 1 and 2, a dryer with an apparatus for detecting a belt-cutoff according to a preferred embodiment of the present invention includes a cabinet 11 forming external profile; a drying drum 12 installed inside the cabinet 11, in which a laundry is loaded; a front frame 20 mounted on a front of the cabinet 11; a front cover 21 mounted on a rear of the front frame 20 to support a front opening of the drying drum 12; a control panel 22 seated on an upper side of the front frame 20 to enable the user to input drying conditions; a base 23 installed in a lower side of the drying drum 12; a door 13 rotatably mounted on a front of the front frame 20; and a motor 30 generating a rotational force as it is seated on one upper side of the base 23.

Particularly, a door lint filter 131 for filtering fluffs is provided in the door 13, and a circulation duct 15 is provided directly under the door 13. And, a body lint filter 151 for filtering fluffs is provided in a inlet of the circulation duct 15. And, a cooling fan 16 for inhaling outside air and a dry fan 18 for inhaling the circulating air discharged toward a front of the drying drum 12 are provided in the base 23. Here, the cooling fan 16 and the dry fan 18 are connected to the motor shaft 31 of the motor 30 as they are disposed facing to each other. And, a belt 17 is surrounded around an outer circumference of the drum 12, and the belt 17 is surrounded around the motor shaft 31. Therefore, the drying drum 12 is rotated as the belt 17 is rotated due to the rotation of the motor shaft 31.

In addition, a dry duct 19 is provided on an outside of the cabinet 11, that is, a rear surface of the dryer 10. Particularly, the dry fan 18 is received in the lower side of the dry duct 19, and the upper portion of the dry duct 19 is connected to a rear of the drying drum 12. And, a heater 14 is provided in the dry duct 19 to heat the circulating air by generating high-temperature heat. And, the rear of the drying drum 12 is connected to the cabinet 11 via a drum shaft 121, and therefore the drying drum 12 is supported.

In addition, the cooling fan 16 is seated inside the base 23, a circulating air duct and a cooling duct are provided in the base 23. And, a condenser is provided at an intersection of the circulating air duct and the cooling duct.

In addition, a radiation element 231 in which a plurality of holes are arranged is formed in the portion on which the motor 30 is seated, so that the heat generated from the motor is rapidly dissipated. And, the motor 30 is connected to the base 23 by means of a spring 40, a micro switch 50 for detecting the cutoff of the belt 17 is provided on one side of the base 23. Here, the belt 17 is connected to the motor shaft 31, and thus, the turning moment is generated at the motor 30 in a direction that extends the spring 40. The spring 40 is connected in order to compensate the turning moment and to prevent the motor 30 from being rotated by the turning moment. This will be explained in detail with reference to drawings.

The operation of the condenser-type dryer 10 having the above constituents will be described.

First, the motor 30 and the heater 14 start to operate by an input of an operation command after loading an object for dry in the drying drum 112. After that, air is introduced into the drying drum 12 as the dry fan 18 connected to the motor 30 is driven. And, the drying drum 12 is rotated as the belt 17 connected to the motor shaft 31 is rotated. And, the indoor air is introduced through the cooling duct formed inside the base by the rotation of the cooling fan 16. And, the circulating air flows along the circulating air duct and the indoor air introduced through the cooling duct are heat-exchanged with each other without being mixed, as they pass the condenser. And, the circulating air is introduced into the dry duct 19 after finishing the heat exchange, and is re-introduced into the drying drum 12 after being heated by the heat 14 inside the dry duct 19. And, the heat exchanged indoor air is discharged to the indoor. Explaining the air flow in more detail, the air inside the drying drum 12 is circulated by the rotation of the dry fan 18. And, the indoor air is inhaled by the cooling fan 16 and is discharged to the indoor after passing through the condenser. And, the circulating air circulating inside the drying drum 12 and the indoor air inhaled by the cooling fan 16 are heat exchanged with each other without being mixed, as they pass the condenser in an intersecting manner. And, a circulating air-through layer and an indoor air-through layer are alternately stacked in the condenser and they are stacked in an intersection manner, and thus, two airs are not mixed with each other but heat exchanged with each other.

Meanwhile, when the belt 17 is cut in the process of rotating the drying drum 12, the motor 30 pushes the micro switch 50 as it is rotated by the elastic force of the spring 40. Here, a structure of pressing the micro switch 50 is formed on the outer circumference of the motor 30. Hereinafter, a structure for detecting when the belt 17 is cut will be explained in more detail with reference to the drawings.

Figure 3:
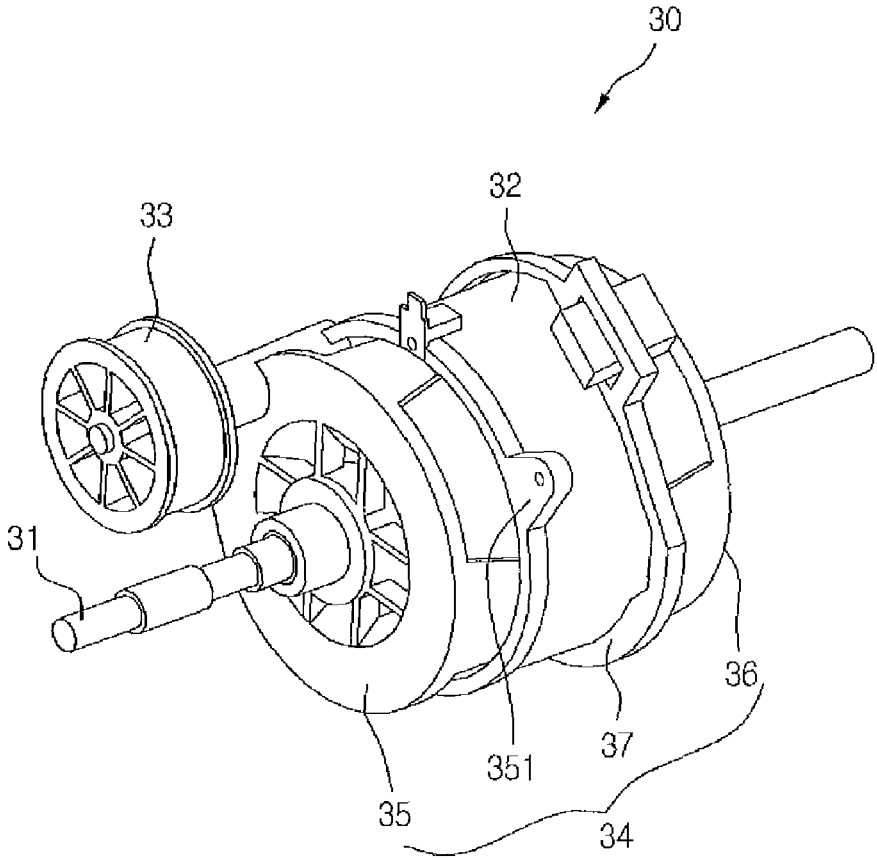
FIG. 3 is an external perspective view of a motor installed in the dryer according to a preferred embodiment of the present invention.
Figure 4:
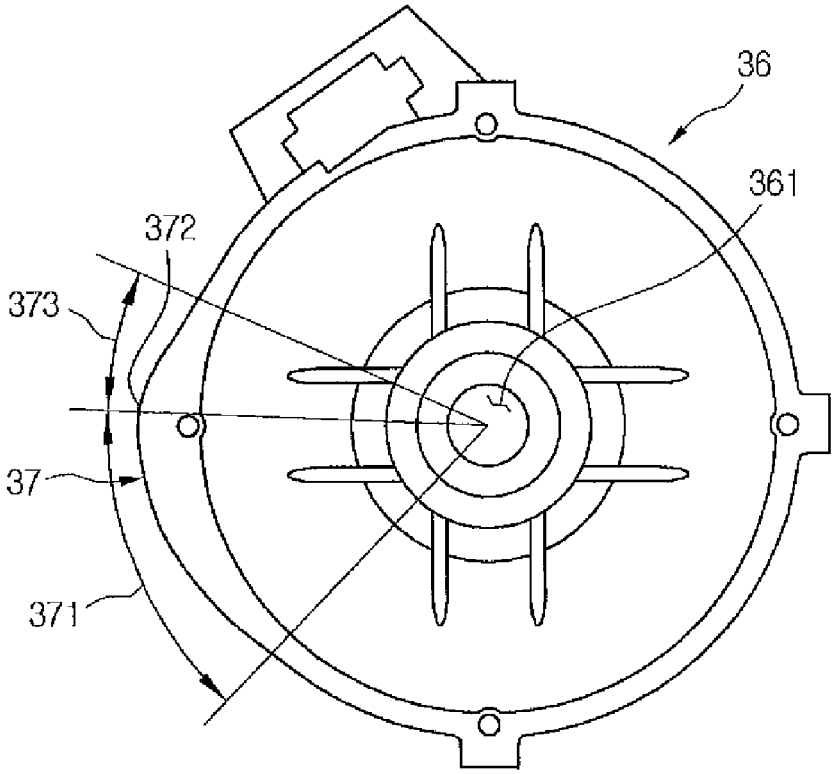
FIG. 4 is a front view showing a rear bracket of a motor.

FIG. 3 shows an external perspective view of a motor mounted on a dryer according to a preferred embodiment of the present invention, and FIG. 4 shows a front view of a rear bracket constituting the motor.

Referring to FIG. 3, a motor 30 according to a preferred embodiment of the present invention includes a motor bracket 34, a stator 32, a rotor (not illustrated) provided in the stator 32 to be rotated, a motor shaft 31 connected to the rotor to be rotated, and a pulley 33 extended from an outer circumference of the motor bracket 34, to which a belt 17 is connected.

Particularly, the motor bracket 34 includes a front bracket 35 surrounding a front of the stator 32, and a rear bracket 36 surrounding a rear of the stator 32. And, the front bracket 35 is provided with the pulley 33, and a spring interlocking member 351 to which one end of the spring 40 is connected.

In addition, a pressing element 37 for pressing the micro switch 50 is provided in the rear bracket 36. And, one side of the belt 17 is tightly surrounded around the pulley 33, but the other side of the belt 17 is tightly surrounded around the drying drum 12. And, a side surrounded around the motor shaft 31 and a side wound around the drying drum 12 are the same side. That is, the belt 17 connected to the pulley 33 and the motor shaft 31 is rounded in the shape of "S."

Referring to FIG. 4, a motor shaft through hole 361 through which a motor shaft 31 passes is formed in a center of the rear bracket 36, and the pressing element 37 is formed at the outer circumference.

Particularly, the pressing element 37 is formed in a shape that is protruded from an edge portion of the rear bracket 36. By means of this structure, the motor 30 itself is rotated about the motor shaft 31 when the belt 17 is cut. And, the pressing element 37 pushes the micro switch 50 while the motor 30 rotates. Here, the motive power, which rotates the motor 30 when the belt 17 is cut, is a moment caused by the elastic force restoring the spring 40 into its initial position.

More particularly, the pressing element 37 is composed of a first bending portion 371 curved at a specific curvature, a second bending portion 373 curved at a specific curvature at the end of the first bending portion 371 and a tip 372 in which the first bending portion 371 is converted into the second bending portion 373, i.e. the highest point of the pressing element 37.

Here, the curvature of the first bending portion 371 is greater than that of the second bending portion 373. That is, the first bending portion 371 is gently curved, the second bending portion 373 is more sharply curved than the first bending portion 371.

The first bending portion 371 is gently curved in order to prevent the micro switch 50 from being pressed by the pressing element 37 in a state that the belt 17 is not cut. Particularly, the motor 30 is biased in its eccentricity by a vibration of the motor 30 itself or of the drum during the rotation of the belt 17. And, the motor 30 itself may be rotated within a specific angle range by the vibration and the eccentricity. In this case, the first bending portion 371 is gently curved to prevent the pressing element 37 from pressing the micro switch 50. Therefore, it is possible to prevent the belt-cutoff from being mistakenly sensed even though the belt is not cut off.

Also, the second bending portion 373 curved at a specific curvature is formed at the point where the first bending portion 371 ends in order to prevent the micro switch from being damaged.

Figure 7:
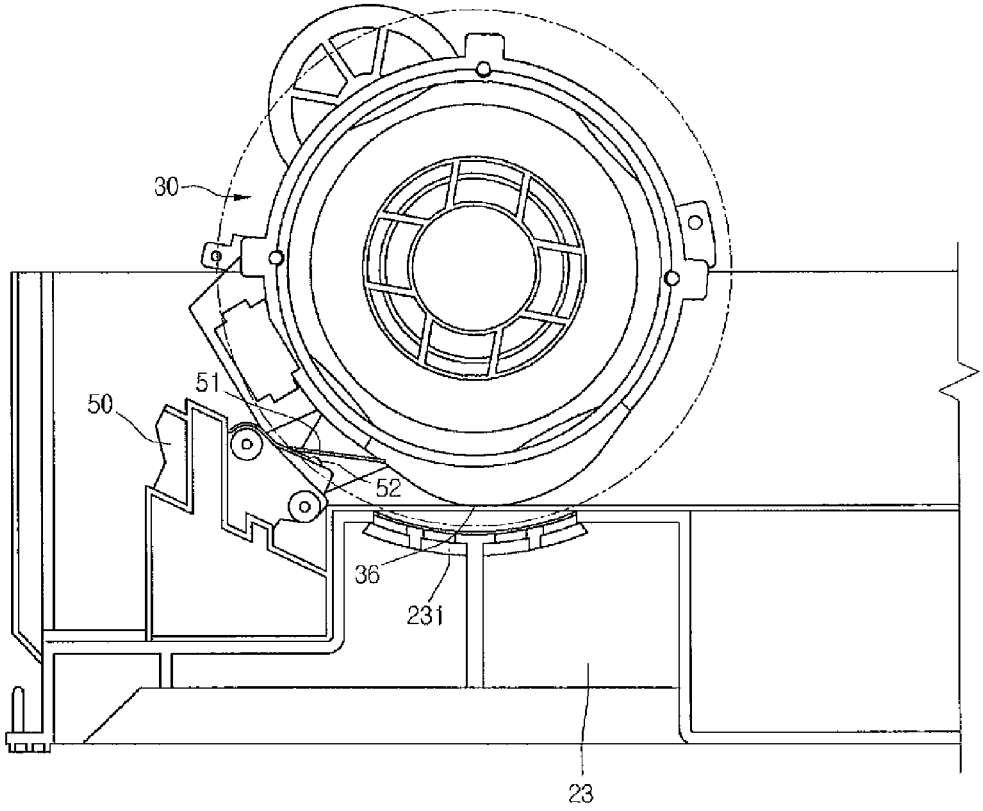
FIG. 7 is a view showing a profile of a radiation element for preventing the interference between a base and a pressing element of a motor.

Particularly, as shown in FIG. 7, the pressing element 37 is frequently disposed under the micro switch 50 while the motor 30 is seated on the base by an assembler. In this case, the assembler rotates the motor to correct the position of the motor 30, and therefore the micro switch may be damaged as it is caught by the pressing element 37 while the motor 30 rotates. In order to prevent this problem, the second bending portion 373 is curved at a specific curvature, and thus, it is possible to prevent the micro switch 50 from being damaged when the motor is not correctly assembled.

Also, the tip 372 is preferably disposed adjacent to the point where the micro switch 50 is pressed, when the turning moment is generated on the motor 30 by the elastic force of the spring 40 due to the belt-cutoff. Particularly, the position of the tip 372 is determined by the amount of the rotation of the motor 30 corresponding to a straight line from the point where the spring 40 is elongated to an initial point of the spring. In other words, the amount of the rotation corresponds to the length of a circular arc extended from the micro switch to the tip 372. This will be explained in more detail with reference to the drawings.

Figure 5:
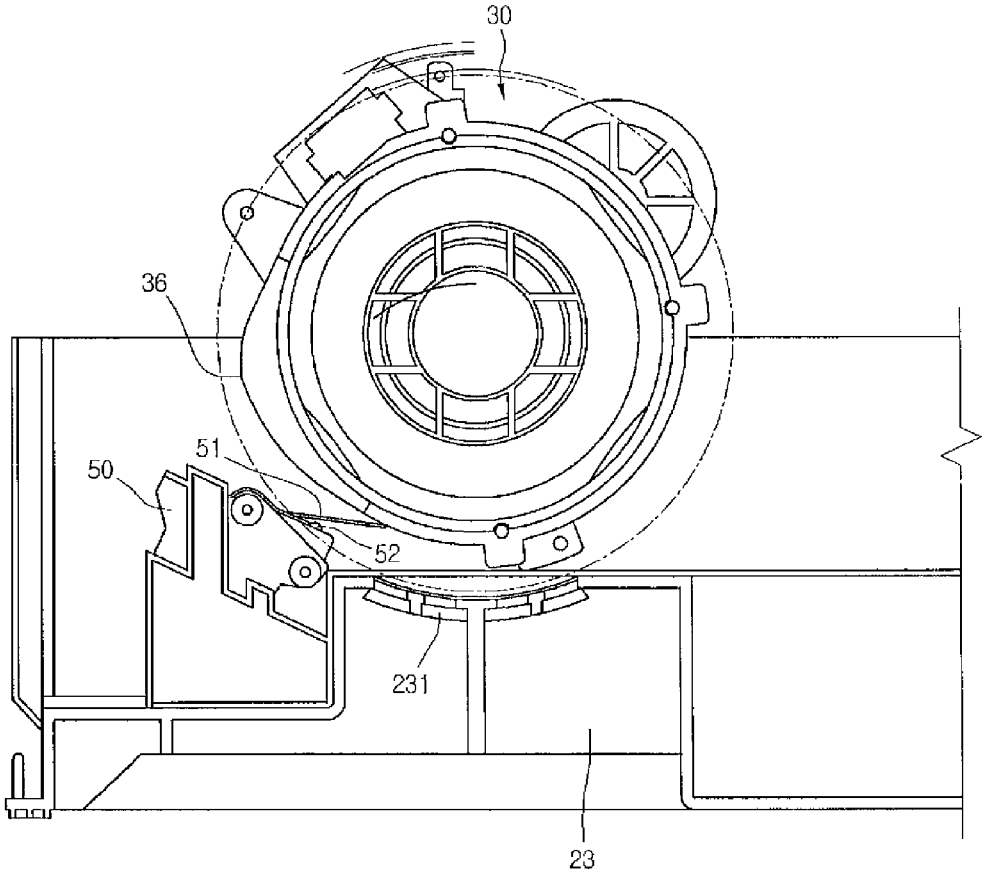
FIG. 5 is a side view showing a state of a motor which is in normal state.
Figure 6:
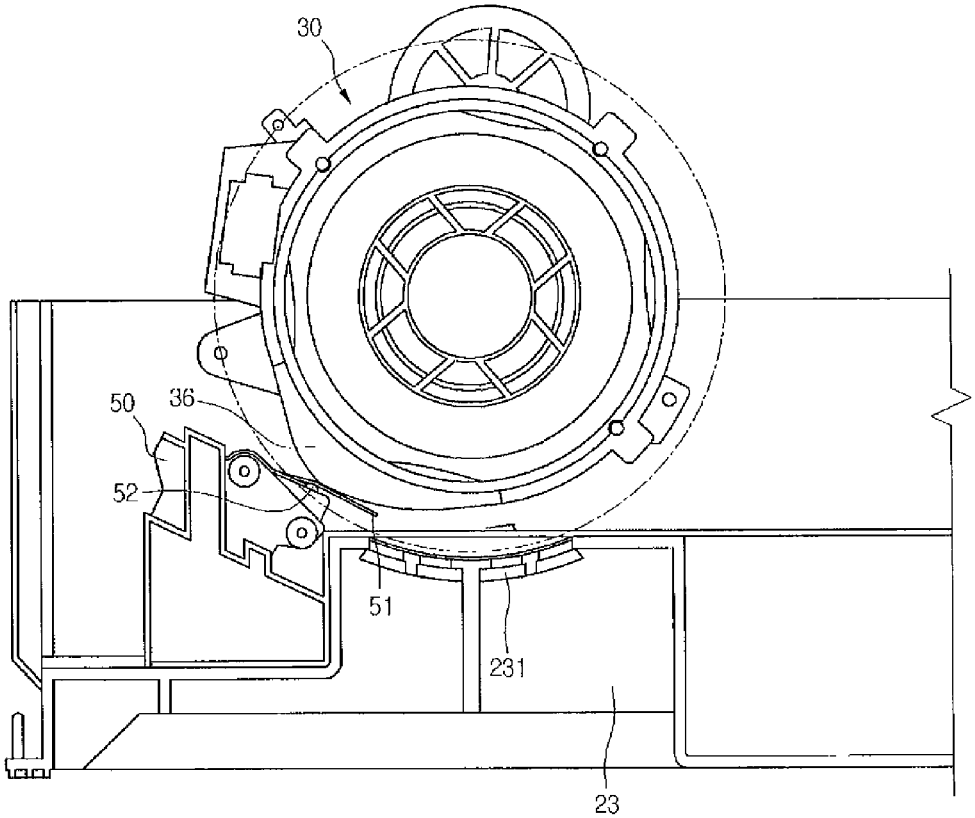
FIG. 6 is a side view showing a state of a motor when the belt-cutoff occurs.

FIG. 5 shows a state of a motor which is in normal state, and FIG. 6 shows a state of a motor when the belt-cutoff occurs.

Referring to FIG. 5, the pressing element 37 is disposed at an upper side of the micro switch 50 by the traction power of the belt 17 in a state that the belt 17 connected to the motor shaft 31 is not cut.

Here, contact lug 52 is protruded from the upper surface of the micro switch 50, and a contact bar 51 is extended above the contact lug 52. And, the contact bar 51 is maintained to be spaced apart from the contact lug 52.

Referring to FIG. 6, the motor 30 is rotated in a counterclockwise direction from the illustrated state by the restoring force of the spring 40 when the belt 17 is cut. And, the pressing element 37 is also rotated in a counterclockwise direction, so that it contacts with the contact bar 52 in order of a tip 372. And, the contact bar 51 is pressed by the pressing element 37, and therefore the contact bar 51 contacts with the contact lug 52. And, the micro switch 50 is turned on when the contact bar 51 contacts with the contact lug 52, and thus, the pulse is generated. And, this pulse signal is transmitted to a control unit, and the control unit recognizes the belt-cutoff.

FIG. 7 shows a profile of a radiation element for preventing the interference between a base and a pressing element of a motor.

Referring to FIG. 7, the pressing element 37 is protruded from the circumference of the rear bracket 36. Therefore, the pressing element 37 may interfere with the radiation element 231 as the pressing element 37 rotates in case that the radiation element 231 of the base 23 is flat.

In order to prevent this possibility, the radiation element 231 is depressed to a predetermined depth. Particularly, the radiation element 231 is preferably curved at the same curvature or more as that of the circle which is drawn while the tip 372 of the pressing element 37 rotates.

More particularly, the pressing element 37 may pass by the micro switch 50 due to the inertia force caused by the self weight of the motor 30, when the motor 30 is rotated by the restoring elastic force of the spring 40. Otherwise, the pressing element 37 is disposed at a lower side of the micro switch 50 due to the mal-assembly mistakenly assembled by the assembler. In these cases, the radiation element 231 is curved at a predetermined depth so that the radiation element 231 is not interfered with the pressing element 37.

Figure 8:
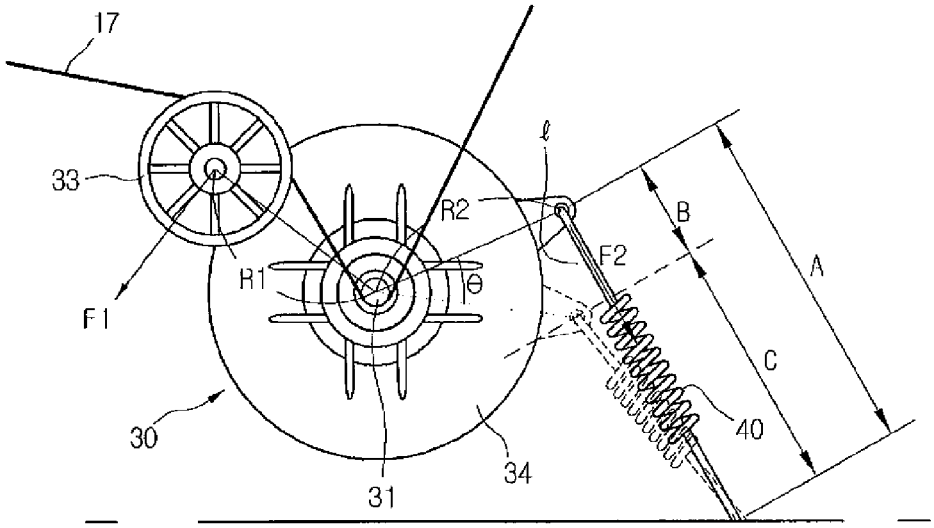
FIG. 8 is a view showing distribution of force exerted on a motor portion in a dryer according to a preferred embodiment of the present invention.

FIG. 8 shows the distribution of force exerted on a motor portion in a dryer according to a preferred embodiment of the present invention.

Referring to FIG. 8, the belt 17 is in a shape of rounding the motor shaft 31 after contacting with the outer circumference of the pulley 33.

Particularly, the tension of the belt 17 exerts on the pulley 33, since the belt 17 is tightly wound around the drying drum 12. That is, a force F1 pressing the pulley 33 acts thereon.

Meanwhile, the spring 40 is compression spring having a predetermined elastic modulus, and the spring is extended and maintained when it is coupled to the motor. Therefore, an elastic force F2 restoring its initial state acts on the spring 40.

Referring to the motor, a turning moment M1 which tends to rotate in a counterclockwise direction is exerted on the motor 30 by the force F1 acting on the pulley, and the magnitude of the turning moment M1 is F1*R1 (R1: radius of the motor).

In addition, a turning moment M2 which tends to rotate in a clockwise direction is exerted on the motor 30 by the elastic force F2 of the spring 40, and the magnitude of the turning moment M2 is F2*R2 (R2: length between the center of the motor and the spring interlocking member). And, the magnitude of these two turning moments is the same, and thus, the motor stays still.

Here, the motor 30 is rotated in a clockwise direction by the moment M2 caused by the spring 40, since the turning moment M1 acting on the pulley is finished when the belt 17 is cut. Therefore, the pressing element 37 presses the contact bar 51 of the micro switch 50 as it rotates.

Meanwhile, an angle of rotation θ of the motor 30 is an angle corresponding to a straight length B which reduces from the extended length A to the initial length C of the spring 40.

That is, $l = R2 * \theta$

In addition, the forming position of the tip 372 is formed at a position where it may press the micro switch 50 when the motor 30 is rotated at the angle of rotation θ in a state that the belt 17 is not cut off.

Figure 9:
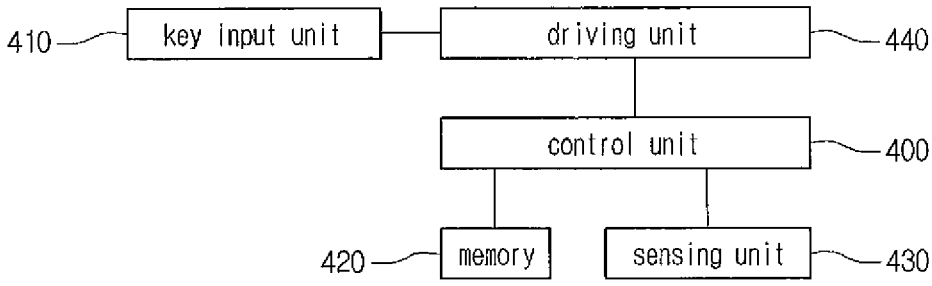
FIG. 9 is a block diagram showing a system construction for implementing a control method of detecting a belt-cutoff of a dryer according to a preferred embodiment of the present invention.

FIG. 9 shows a block diagram of a system construction for implementing a control method of detecting a belt-cutoff of a dryer according to a preferred embodiment of the present invention.

Referring to FIG. 9, a system of a dryer for implementing a control method of detecting a belt-cutoff according to the present invention includes a control unit 400, a key input unit 410 for inputting a dry condition and an operation command, a driving unit 440 for driving the motor and the heater depending on the inputted dry condition, a belt cut detecting unit 430 for detecting a belt-cutoff and a memory 420 in which data are stored.

Particularly, the belt cut detecting unit 430 is the above described micro switch 50.

According to this construction, the belt cut detecting unit 430 senses when the motor 30 is rotated as the belt 17 is cut, and the sensed signal is transmitted to the control unit 400. And, the control unit 400 commands to stop the motor and the heater by delivering a control signal, which stops the operation of the driving unit 440 by judging the signal.

Hereinafter, a control method of detecting a belt-cutoff will be explained in more detail with reference to the flowchart.

Figure 10:
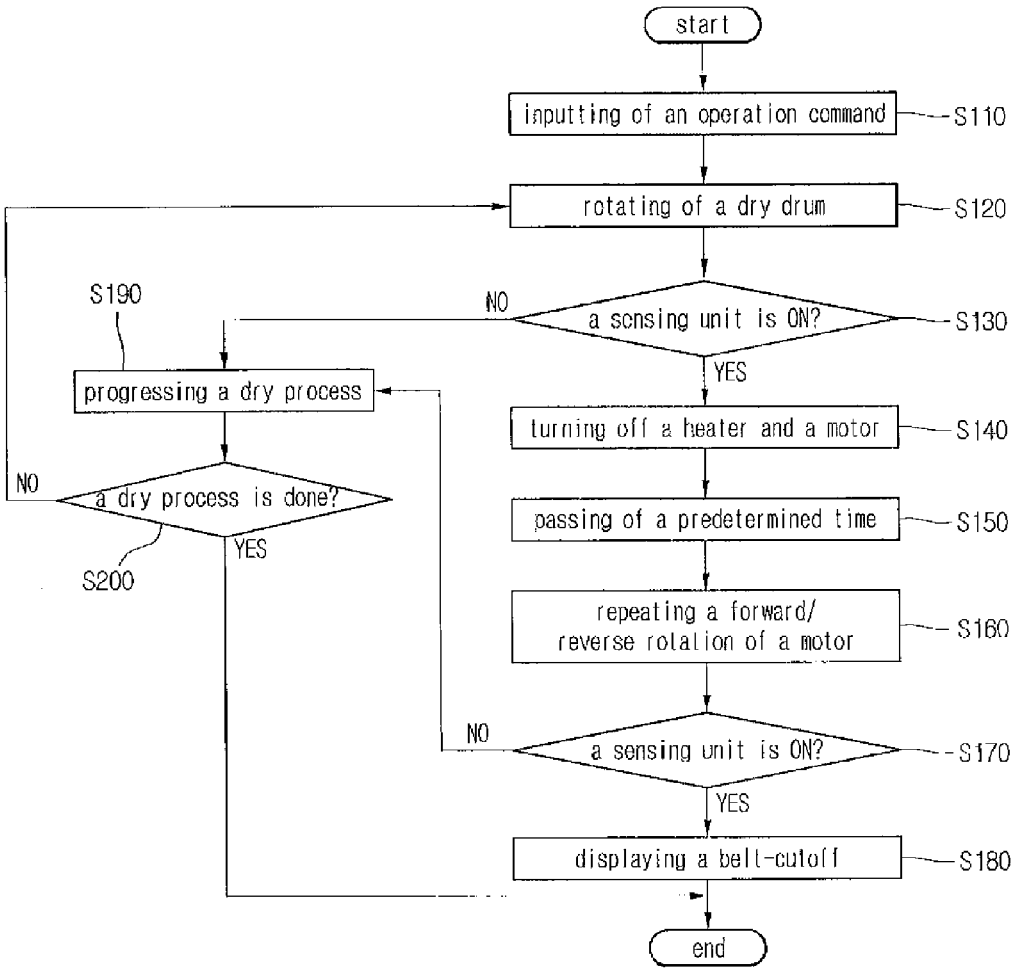
FIG. 10 is a flowchart showing a control method of detecting a belt-cutoff of a dryer according to a preferred embodiment of the present invention.

FIG. 10 shows a flowchart explaining a control method of detecting a belt-cutoff of a dryer according to a preferred embodiment of the present invention.

Referring to FIG. 10, a user inputs a dry condition and an operation command by using operation buttons (S110). And, a motor is driven according to the dry condition and the operation command and a drying drum is rotated.

Also, the control unit 400 decides whether the belt-cutoff signal is generated during the dry process. In other words, it decides whether the belt cut detecting unit is turned on or not in real time. Here, what "the belt cut detecting unit is turned on" means that the electrical signal is generated as the pressing element 37 presses the micro switch 50.

Meanwhile, a dry process progresses according to the inputted dry condition when the belt cut detecting unit-turned on signal is not received in the control unit And, the dry process is finished as the operation of the dryer is stopped when the dry process is completed after deciding whether the dry process is completed or not (S200). And, in case that the dry process is not completed, the drying drum continues to rotate (S120), and the step of deciding (S130) whether the belt cut detecting unit is turned on or not continues to operate.

However, the heater and the motor are stopped simultaneously when the control unit receives the belt cut detecting unit-turned on signal. If the motor and the heater continue to operate even though the belt-cutoff signal is received, it will cause the possibility of fire due to the overheated heater and the overheated dry drum.

Also, a forward/reverse rotation of the motor is repeatedly implemented (S160) when the motor and the heater are stopped and a predetermined time goes on (S150). And, whether the belt cut detecting unit is turned on or not is sensed again (S170). This is because the belt cut detecting unit on signal may be generated due to electrical noise even though the belt is not cut. That is, when the belt cut detecting unit-on signal is generated, the motor and the heater are stopped and the belt cut detecting unit-on signal is re-checked about that the signal is caused by the belt-cutoff or the electrical noise.

Meanwhile, if the belt cut detecting unit is decided to be turned on, then it is regarded as a belt-cutoff, and a belt-cutoff signal is displayed on the display unit (S180). It is possible to display the belt-cutoff signal by means of a voice, a letter and a light. If the belt cut detecting unit is not decided to be turned on, then it is regarded as an electrical noise, and thus, a normal dry process (S190~200) operates.

By using the control method, it is possible to promptly sense the cutoff of the belt wound around the drying drum 12 as well as to promptly sense that the belt is actually cut or not. And, the reduction of the power consumption and the stability of the product are guaranteed by stopping the operation of the driving unit when the belt is cut off.

What is claimed is:

1. An apparatus for detecting a belt-cutoff of a dryer, comprising:

a drying drum accommodating a laundry therein;

a motor applying a rotational force to the drying drum and provided with a pressing element protruded from one side of an outer circumference thereof;

a base on which the motor is seated;

a belt wound around the drying drum and a rotating shaft of the motor; and a belt cut detecting unit provided adjacent to the motor for detecting the belt-cutoff, wherein the belt cut detecting unit is pressed as the motor is rotated by a turning moment when the belt is cut off, wherein the pressing element is formed on the outer circumference of the motor as it is curved at a predetermined curvature, and wherein the pressing element includes:

a first bending portion which is curved at a specific curvature in order to prevent the belt cut detecting unit from being pressed by the pressing element;

a second bending portion which is connected to the first bending portion and is curved at a curvature that is greater than the curvature of the first bending portion in order to prevent the belt cut detecting unit from being damaged when the motor is not correctly assembled while the motor is seated on the base; and a tip in which the first bending portion is converted into the second bending portion.

2. The apparatus according to claim 1, further comprising:

a spring for supporting the motor, wherein the turning moment is caused by an elastic force of the spring.

3. The apparatus according to claim 1, wherein a radiation element depressed to a predetermined depth is formed in an upper surface of the base on which the motor is seated.

4. The apparatus according to claim 1, wherein the belt cut detecting unit includes a micro switch.

5. The apparatus according to claim 4, wherein the amount of the rotation, which allows the tip of the pressing element to contact with the micro switch, is at least the same as the amount of the rotation of the motor corresponding to a straight line from a point, where the spring is elongated, to an initial point of the spring.

6. The apparatus according to claim 3, wherein the radiation element is preferably curved at the same curvature or more as that of a circle which is formed while the tip of the pressing element rotates, so that the radiation element does not interfere with the pressing element.

* * * * *